US008796568B2

(12) United States Patent
Mrowiec et al.

(10) Patent No.: US 8,796,568 B2
(45) Date of Patent: Aug. 5, 2014

(54) SWITCHING ASSEMBLY HAVING AN INTERLOCK DEVICE FOR A SELECTOR SWITCH

(75) Inventors: Jacek Stanislaw Mrowiec, Bielsko-Biala (PL); Przemyslaw Eugeniusz Cieply, Bielsko-Biala (PL); Marcin Piotr Lagiewka, Bielsko-Biala (PL); Rafal Marek Mrotek, Bielsko-Biala (PL)

(73) Assignee: General Electric Company, Schenectady, NY (US)

( * ) Notice: Subject to any disclaimer, the term of this patent is extended or adjusted under 35 U.S.C. 154(b) by 763 days.

(21) Appl. No.: 12/980,803

(22) Filed: Dec. 29, 2010

(65) Prior Publication Data

US 2012/0168287 A1 Jul. 5, 2012

(51) Int. Cl.
*H01H 9/20* (2006.01)
*H01H 31/00* (2006.01)

(52) U.S. Cl.
USPC ..... 200/50.01; 200/43.01; 200/43.06

(58) Field of Classification Search
USPC ..... 200/50.01, 43.01, 43.11, 43.16, 43.19
See application file for complete search history.

(56) References Cited

U.S. PATENT DOCUMENTS

| | | | | |
|---|---|---|---|---|
| 4,604,605 | A * | 8/1986 | Meyers et al. | 341/34 |
| 5,113,043 | A * | 5/1992 | Morris | 200/43.01 |
| 5,260,528 | A | 11/1993 | Benda | |
| 5,467,622 | A * | 11/1995 | Becker et al. | 70/203 |
| 5,500,495 | A | 3/1996 | Benda et al. | |
| 5,844,186 | A | 12/1998 | Meriwether | |
| 6,506,986 | B2 * | 1/2003 | Bernier et al. | 200/50.01 |
| 6,992,872 | B2 | 1/2006 | Morris et al. | |
| 7,399,934 | B2 | 7/2008 | Emura et al. | |
| 8,115,127 | B2 * | 2/2012 | Nguyen et al. | 200/330 |

FOREIGN PATENT DOCUMENTS

| | | | |
|---|---|---|---|
| DE | 19548948 | A1 | 7/1997 |
| EP | 0274624 | A1 | 7/1988 |
| WO | 2010071922 | A1 | 7/2010 |

OTHER PUBLICATIONS

Search Report and Written Opinion from corresponding EP Application No. 11194073, May 11, 2012.

* cited by examiner

*Primary Examiner* — Renee Luebke
*Assistant Examiner* — Lheiren Mae Caroc
(74) *Attorney, Agent, or Firm* — Cantor Colburn LLP

(57) ABSTRACT

A switching assembly having an interlock device for a selector switch is provided. The interlock device includes a flapper member rotatably coupled to a base member. The flapper member has an aperture disposed proximate to an aperture of a panel such that the selector switch extends through the apertures. The flapper member further includes an indented region and has a first operational position proximate to the panel and a second operational position disposed outwardly from the panel. When an arm portion of the selector switch is disposed within the indented region of the flapper member at the second rotational position and the flapper member is rotated to the second operational position, then the arm portion cannot be rotated outside of the indented region.

21 Claims, 7 Drawing Sheets

SWITCHING ASSEMBLY HAVING AN INTERLOCK DEVICE FOR A SELECTOR SWITCH

BACKGROUND OF THE INVENTION

The subject matter disclosed herein relates to a switching assembly having an interlock device for a selector switch.

BRIEF DESCRIPTION OF THE INVENTION

An interlock device for a selector switch in accordance with an exemplary embodiment is provided. The interlock device includes a base member configured to be disposed adjacent to a panel and having an aperture extending therethrough proximate to an aperture of the panel. The interlock device further includes a flapper member rotatably coupled to the base member. The flapper member has an aperture extending therethrough that is disposed proximate to the aperture of the panel such that at least a portion of the selector switch extends through the aperture of the flapper and the aperture of the panel. The flapper member further includes an indented region. The flapper member has a first operational position in which the flapper member is disposed proximate to the panel and a second operational position in which the flapper member is disposed outwardly from the panel. When an end portion of an arm portion of the selector switch is disposed within the indented region of the flapper member at the second rotational position and the flapper member is rotated to the second operational position, then the arm portion cannot be rotated outside of the indented region.

A switching assembly in accordance with another exemplary embodiment is provided. The switching assembly includes an interlock device having a base member and a flapper member. The base member is configured to be disposed adjacent to a panel and having an aperture extending therethrough proximate to an aperture of the panel. The flapper member is rotatably coupled to the base member. The flapper member has an aperture extending therethrough that is disposed proximate to the aperture of the panel. The flapper member further includes an indented region. The flapper member has a first operational position in which the flapper member is disposed proximate to the panel and a second operational position in which the flapper member is disposed outwardly from the panel. The switching assembly further includes a selector switch having a body member and a rotatable member. The body member is configured to be disposed through the aperture of the flapper member and the aperture in the base member. The body member is configured to be mounted to the panel. The body member has an internal region. The rotatable member has a body portion and an arm portion coupled to the body portion. The body portion is at least partially disposed in the internal region of the body member and at least a portion of the body portion extends through the aperture of the base member and through the aperture in the panel. The rotatable member is rotatable between a first rotational position and a second rotational position. The switching assembly further includes a drive mechanism coupled to the rotatable member proximate to a second side of the panel. The drive mechanism is rotated between a third operational position and a fourth operational position in response to the arm portion being rotated between the first rotational position and the second rotational position, respectively. The switching assembly further includes a contact block having an electrical contact with a first operational state when the drive mechanism is at the third operational position, and a second operational state when the drive mechanism is at the fourth operational position. When an end portion of the arm portion is disposed within the indented region of the flapper member at the second rotational position and the flapper member is rotated to the second operational position, then the arm portion cannot be rotated outside of the indented region and the drive mechanism is maintained at the fourth operational position and the electrical contact is maintained in the second operational state.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
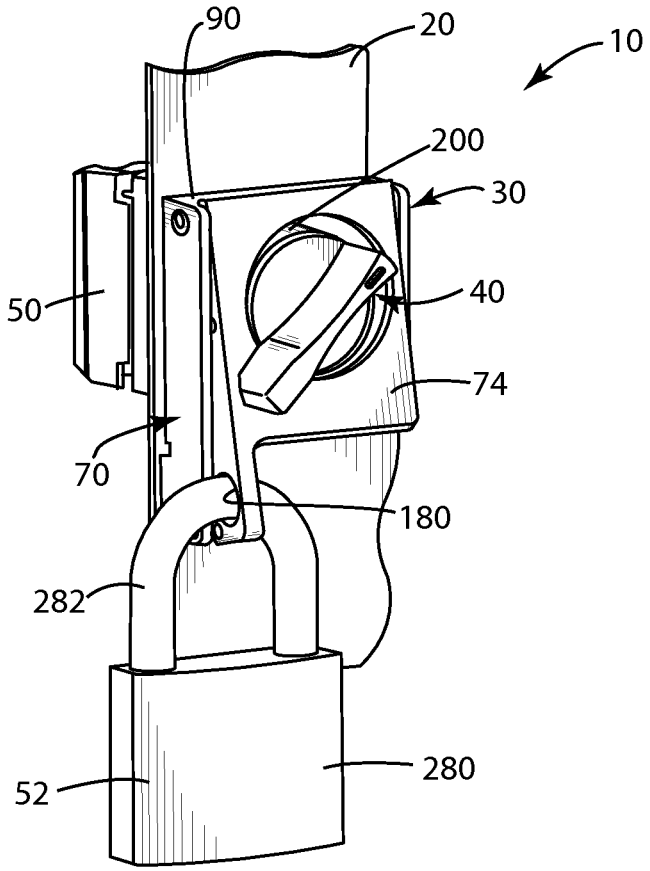
FIG. 1 is a schematic of a switching assembly in accordance with an exemplary embodiment.

The detailed description explains embodiments of the invention, together with advantages and features, by way of example with reference to the drawings.

DETAILED DESCRIPTION OF THE INVENTION

Referring to FIGS. 1-3, 7 and 8, a switching assembly 10 in accordance with an exemplary embodiment that is coupled to a panel 20 is illustrated. The switching assembly 10 includes an interlock device 30, a selector switch 40, a drive mechanism 44, a contact block 50, and a locking device 52. An advantage of the assembly 10 is that the assembly utilizes the interlock device 30 that allows a user to easily lock the assembly at a desired operational position.

The interlock device 30 is configured to be disposed adjacent to the panel 20 and to lock the selector switch 40 at a predetermined operational position. The interlock device 30 includes a base member 70, a flapper member 74, a spring 76, and a pin member 78.

The base member 70 has a mounting plate 90 and first and second side plates 94, 96 extending outwardly from first and second ends, respectively, of the mounting plate 90. The mounting plate 90 is configured to be coupled to the panel 20. The mounting plate 90 has an aperture 106 extending therethrough that is aligned with the aperture 22 extending through the panel 20. The side plate 94 has apertures 110, 112 extending therethrough. The side plate 96 has an aperture (not shown) extending therethrough that is co-linear with an axis extending through the aperture 110. The pin member 78 extends through the aperture 110, an aperture extending through the flapper member 74, and an aperture in the side plate 96. The flapper member 74 is rotatable about the pin member 78 relative to the base member 70. In one exemplary embodiment, the base member 70 is constructed of steel. Of course, in alternative embodiments, the base member 70 could be constructed of other materials such as plastic for example.

Figure 3:
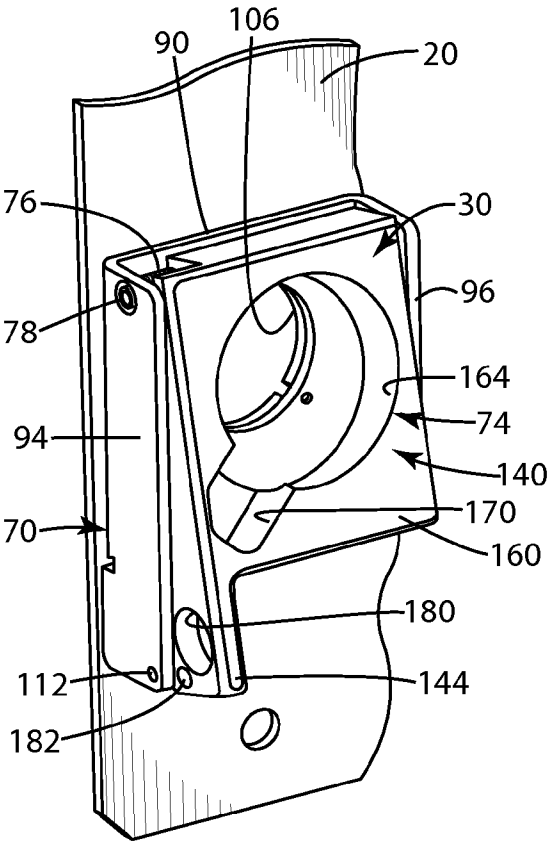
FIG. 3 is another schematic of a portion of the interlock device utilized in the switching assembly of FIG. 1.
Figure 2:
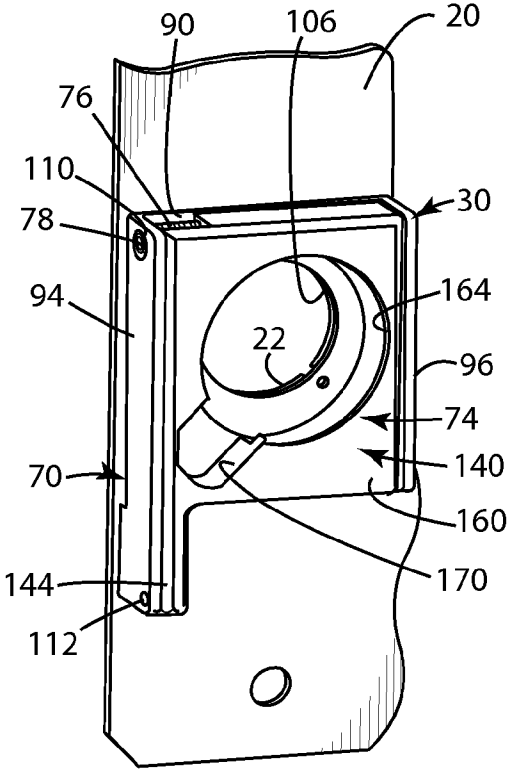
FIG. 2 is a schematic of a portion of an interlock device utilized in the switching assembly of FIG. 1.

The flapper member 74 rotatably coupled to the base member 70. The flapper member 74 has a cover portion 140 and a protrusion portion 144 coupled to the cover portion 140. The cover portion 140 is rotatably coupled to the first and second side plates 94, 96 of the base member 70 utilizing the pin member 78. The spring 76 is operably coupled to the base member 70 and the flapper member 74 and is configured to bias the flapper member 74 outwardly from the panel 20. The cover portion 140 has a front surface 160, an aperture 164 extending through the cover portion 140, and an indented region 170 disposed proximate to the aperture 164. The aperture 164 is disposed proximate to the apertures 106 and 22 such that at least a portion of the selector switch 40 extends through the apertures 164, 106, 22. The protrusion portion 144 extends from the cover portion 140 and is disposed proximate to the side wall 94. The protrusion portion 144 has apertures 180, 182 extending therethrough. Referring to FIG. 2, when the flapper member 74 is at a first operational position, the protrusion portion 144 is disposed proximate to the panel 20. Referring to FIG. 3, when the flapper member 74 is at the second operational position, the protrusion portion 144 is disposed outwardly from the panel 20, such that the aperture 180 of the protrusion portion 144 is not disposed directly adjacent to the side plate 94 of the base member 70. In one exemplary embodiment, the flapper member 74 is constructed of an aluminum alloy. Of course, in alternative embodiments, the flapper member 74 could be constructed of other materials such as steel or plastic for example.

Figure 4:
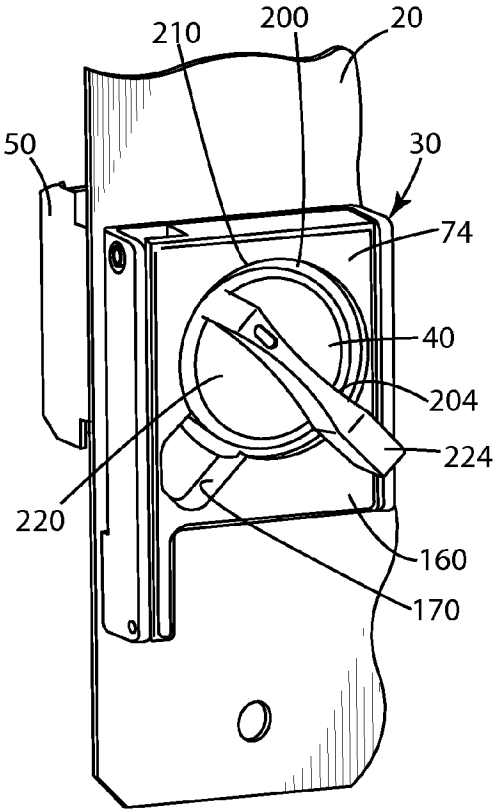
FIG. 4 is a schematic of the switching assembly of FIG. 1 when a selector switch is at a first rotational position and a flapper member is at a first operational position.
Figure 8:
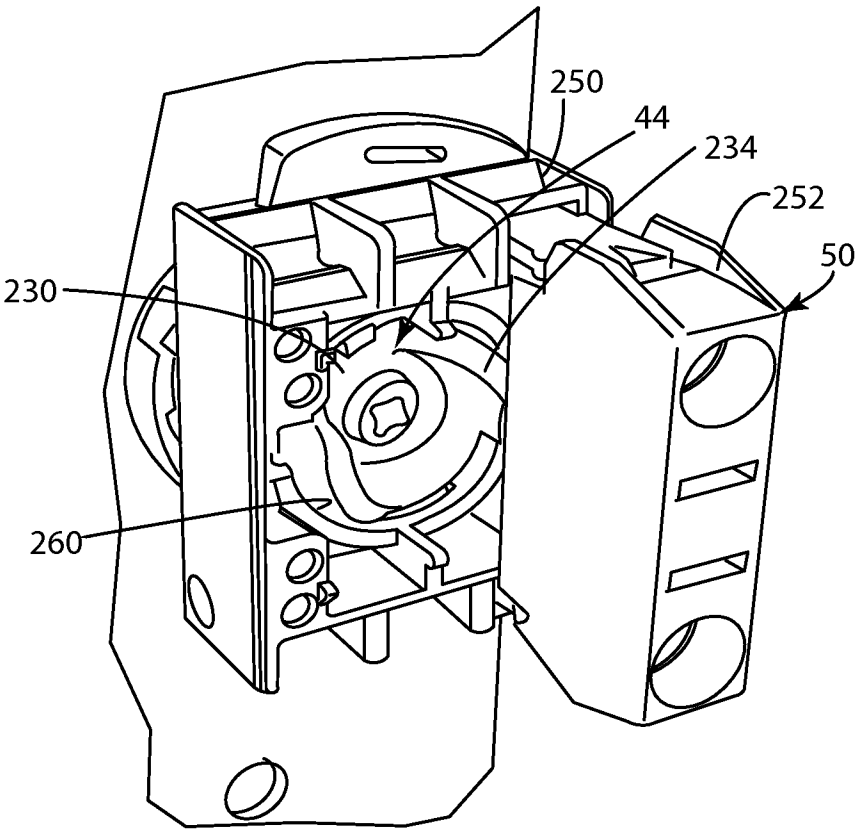
FIG. 8 is a rear view of a portion of the switching assembly of FIG. 1 illustrating a drive mechanism and a contact block.
Figure 7:
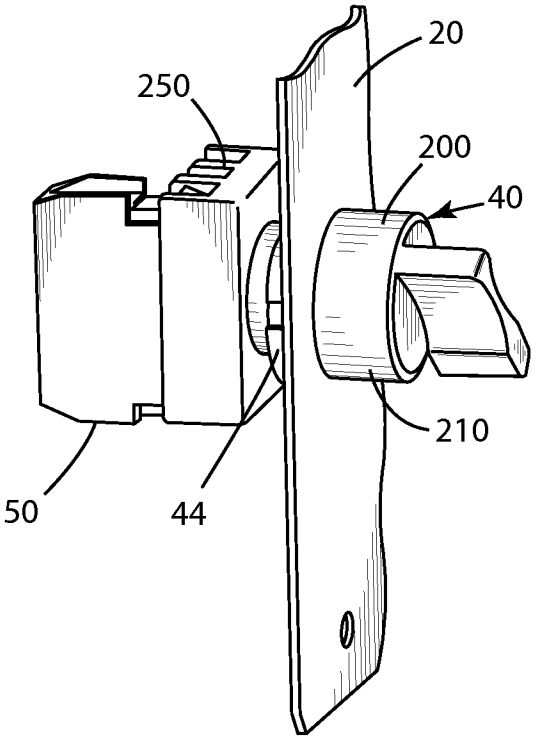
FIG. 7 is a side view of a portion of the switching assembly of FIG. 1.

Referring to FIGS. 2, 4 and 8, the selector switch 40 is provided to induce the drive mechanism 44 to set an operational state of at least one electrical contact in the contact block 50. The selector switch 40 includes a body member 200 and a rotatable member 204 coupled to the body member 200. In one exemplary embodiment, the selector switch 40 is constructed of plastic. Of course, in alternative embodiments, the selector switch 40 could be constructed of other materials such as steel for example.

The body member 200 includes a tubular portion 210 having an interior region. The body member 200 is configured to be disposed through the aperture 164 of the flapper member 74 and the aperture 106 in the base member 70 and the aperture 22 of the panel 20. The body member 200 is further configured to be mounted to the panel 20 by means of the ring nut positioned at the second side of the panel 20.

The rotatable member 204 has a body portion 220 and an arm portion 224 coupled to the body portion 220. The body portion 220 is at least partially disposed in the internal region of the tubular portion 210 and at least a portion of the body portion 220 extends through the aperture 106 of the base member 70 and through the aperture 22 in the panel 20. The rotatable member 204 is rotatable between a first rotational position (shown in FIG. 4) and a second rotational position (shown in FIGS. 5 and 6).

Referring to FIGS. 2 and 4, when the flapper member 74 is at the first operational position and the rotatable member 204 of the selector switch 40 is at a first rotational position, the arm portion 224 is disposed on the front surface 160 of the cover portion 140. At this position, the rotatable member 204 is rotatable toward the indented region 170. However, the flapper member 74 cannot be rotated outwardly from the panel 20.

Figure 5:
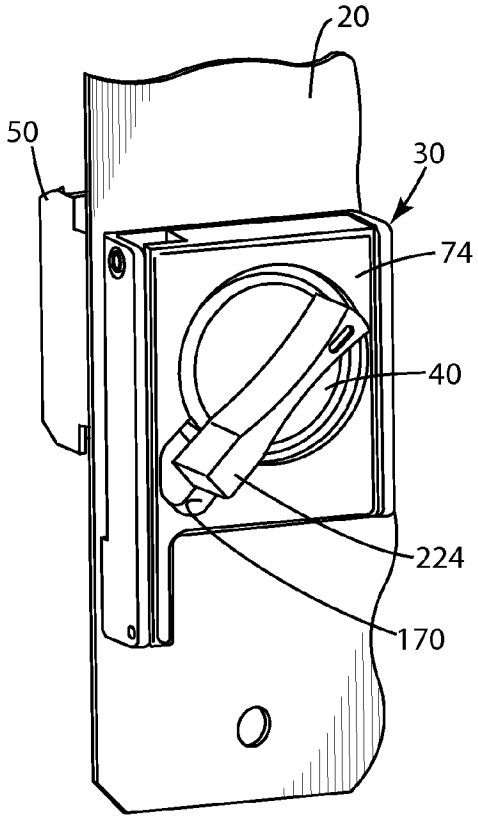
FIG. 5 is a schematic of the switching assembly of FIG. 1 when the selector switch is at a second rotational position and the flapper member is at the first operational position.

Referring to FIGS. 2 and 5, when the flapper member 74 is at the first operational position and the rotatable member 204 of the selector switch 40 is at a second rotational position, the arm portion 224 is disposed proximate to the indented region 170. At these positions, the flapper member 74 is rotatable outwardly from the panel 20.

Figure 6:
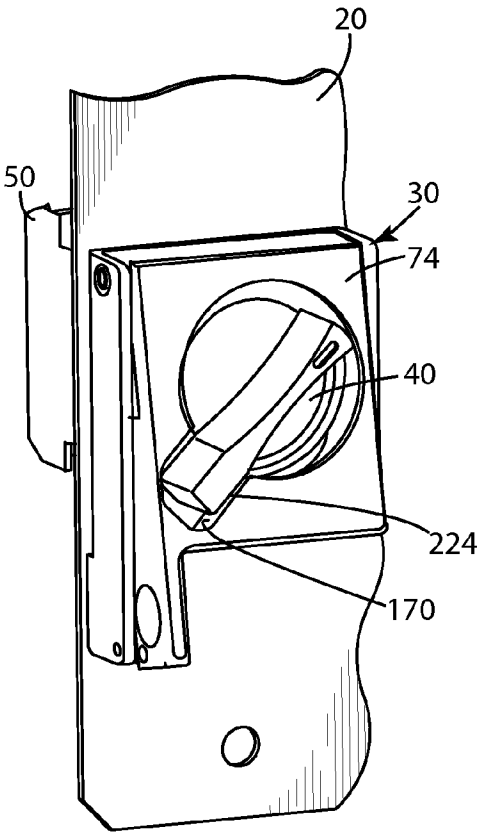
FIG. 6 is a schematic of the switching assembly of FIG. 1 when a selector switch is at the second rotational position and the flapper member is at a second operational position.

Referring to FIGS. 3 and 6, when the flapper member 74 is at the second operational position and the rotatable member 204 is at the second rotational position, the arm portion 224 is disposed in the indented region 170. At these positions, the rotatable member 204 is not rotatable outside of the indented region 170 since the member 204 is constrained within the indented region 170.

Referring to FIGS. 4 and 7-10, the drive mechanism 44 is provided to adjust an operational state of at least one electrical contact 270 in the contact block 50. The drive mechanism includes a coupling portion 230 and a protrusion 234 extending from the coupling portion 230. The coupling portion 230 is coupled to the body portion 220 of the rotatable member 204 of the selector switch 40 proximate to a second side of the panel 20.

Figure 9:
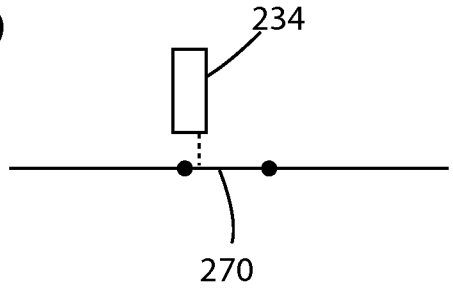
FIG. 9 is a schematic of an electrical contact utilized in the contact block of FIG. 8 and a portion of the drive mechanism of FIG. 8.

The drive mechanism 44 is disposed at a third operational position (shown in FIG. 9) when the arm portion 224 has a first rotational position (shown in FIG. 4) such that the electrical contact 270 in the contact block 50 has a first operational state (e.g., a closed operational state shown in FIG. 9). The drive mechanism 44 is disposed at a fourth operational position (shown in FIG. 10) when the arm portion 224 has a second rotational position (shown in FIG. 6) such the electrical contact 270 in the contact block 50 has a second operational state (e.g., an open operational state shown in FIG. 10). It should be noted that in an alternative embodiment of the switching assembly 10, the first operational state of the electrical contact 270 is an open operational state, and the second operational state of the electrical contact 270 is a closed operational state.

Referring to FIG. 8, the selector switch 40 also includes a housing 250. The contact block 50 has housing portion 252. The housing portion 250 has an aperture 260 extending therethrough that is configured to receive the coupling portion 230 therein. The housing portion 250 is coupled to the body member 200 at a second side of the panel 20. The housing portion 252 has the electrical contact 270 therein. The housing portion 252 is configured to be coupled to the housing portion 250 such that the protrusion 234 can selectively actuate the electrical contact 270.

The operation of the switching assembly 10 will now be explained.

Referring to FIGS. 4 and 9, when the flapper member 74 is at a first operational position and the rotatable member 204 is at a first rotational position, the arm portion 224 is disposed on the front surface 160 of the cover portion 140. Also, the rotatable member 204 induces the drive mechanism 44 to be at a third rotational position causing the electrical contact 270 to have a first operational state (e.g., a closed operational state). At this position, the rotatable member 204 is rotatable toward the indented region 170. However, the flapper member 74 cannot be rotated outwardly from the panel 20.

Figure 10:
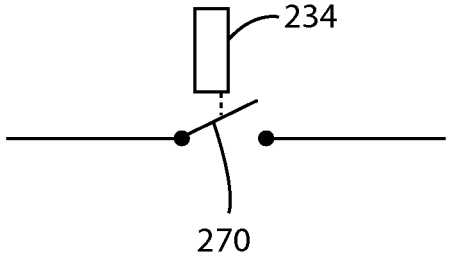
FIG. 10 is another schematic of the electrical contact utilized in the contact block of FIG. 8 and a portion of the drive mechanism of FIG. 8.

Referring to FIGS. 5 and 10, when the flapper member 74 is at a first operational position and the rotatable member 204 is rotated to a second rotational position, the arm portion 224 is disposed proximate to the indented region 170. The rotatable member 204 induces the drive mechanism 44 to be at a fourth rotational position causing the electrical contact 270 to have second operational state (e.g., an open operational state). At this position, the flapper member 74 is rotatable outwardly from the panel 20.

Referring to FIGS. 6 and 10, when the flapper member 74 is at the second operational position and the rotatable member 204 is at the second rotational position, the arm portion 224 is disposed in the indented region 170. The rotatable member 204 induces the drive mechanism 44 to be at the fourth rotational position causing the electrical contact 270 to have a second operational state (e.g., an open operational state). At this position, the rotatable member 204 is not rotatable outside of the indented region 170 since the member 204 is constrained within the indented region 170. Thus, the electrical contact 270 can be maintained at the second operational state.

Referring to FIG. 1, a locking device 52 having a body 280 and a locking bail 282 is illustrated. The locking bail 282 can be disposed through the aperture 180 in the flapper member 74 such that an end portion of the arm portion 224 of the selector switch 40 is constrained with the indented region 170 and cannot be rotated from the second operational position. Thus, the selector switch 40 is locked in the second operational position.

Figure 11:
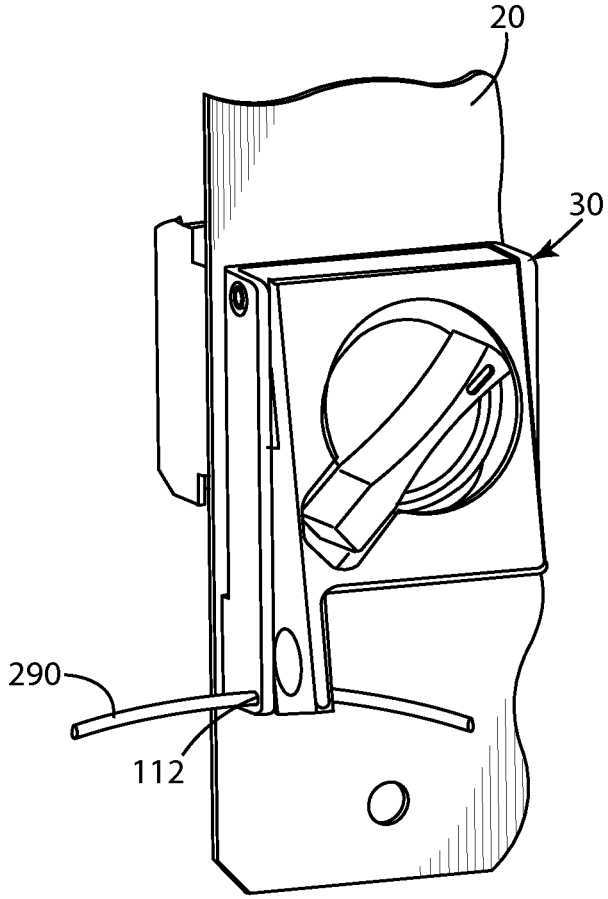
FIG. 11 is another schematic of the switching assembly of FIG. 1 utilizing a seal wire.

Referring to FIGS. 3 and 11, a seal wire 290 can also be inserted through the aperture 112 in the side plate 94 and the aperture 182 in the flapper member 74 such that an end portion of the arm portion 224 of the selector switch 40 is constrained with the indented region 170 and cannot be rotated from the second operational position. Thus, the selector switch 40 is locked in the second operational position.

Figure 12:
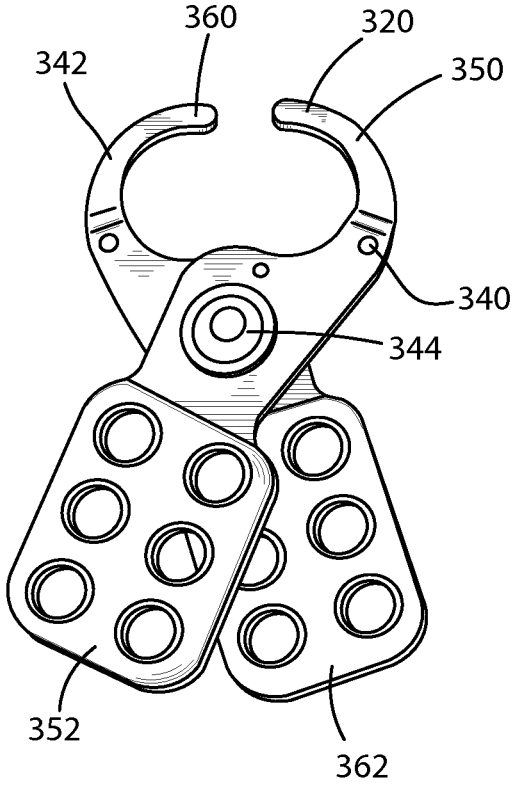
FIG. 12 is a schematic of a hasp device that can be coupled to a flapper member of the interlock device of FIG. 2.
Figure 13:
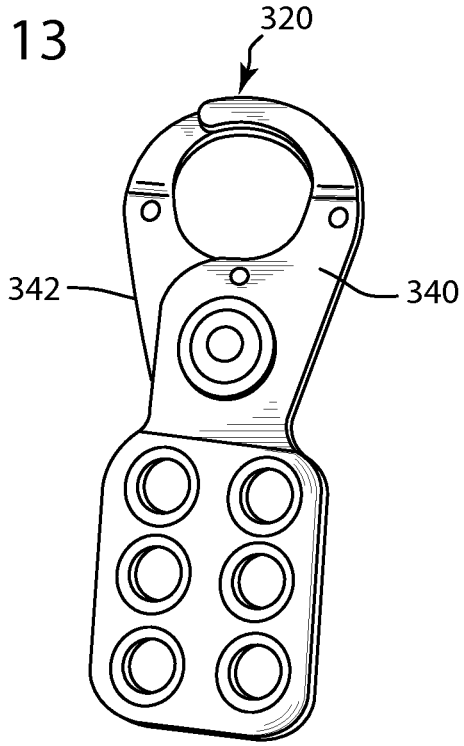
FIG. 13 is another schematic of the hasp device of FIG. 12.

Referring to FIGS. 1, 12 and 13, a hasp device 320 that can be coupled to the flapper member 74 is illustrated. In particular, the hasp device 320 has first and second rotatable members 340, 342 rotatably coupled together at a pivot joint 344. The first rotatable member 340 includes a tip portion 350 coupled to an end portion 352. The end portion 352 has a plurality of apertures extending therethrough. The second rotatable member 342 includes a tip portion 360 coupled to an end portion 362. The end portion 362 has a plurality of apertures extending therethrough. The tip portions 350, 360 can be positioned through the aperture 180 in the flapper member 74 and then be disposed proximate to one another to lock the position of the flapper member 74 outwardly from the panel 20. Also, a locking bail from one or more locking devices 52 can be positioned through corresponding apertures in the end portions 352, 362 to lock a position of the tip portions 350, 360 proximate to one another.

The switching assembly 10 having the interlock device 30 provide a substantial advantage over other devices. In particular, the interlock device 30 provides a technical effect of allowing a user to easily lock a position of a selector switch in the switching assembly.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

We claim:

1. An interlock device for a selector switch, comprising:

a base member configured to be disposed adjacent to a panel and having an aperture extending therethrough proximate to an aperture of the panel;

a flapper member rotatably coupled to the base member, the flapper member having an aperture extending therethrough that is disposed proximate to the aperture of the panel such that at least a portion of the selector switch extends through the aperture of the flapper and the aperture of the panel, the flapper member further having an indented region configured and disposed to receive an arm portion of the selector switch, the flapper member having a first operational position in which the flapper member is disposed proximate to the panel and a second operational position in which the flapper member is disposed outwardly from the panel;

wherein, when in the second operational position, the indented region constrains operation of the selector switch.

2. The interlock device of claim 1, wherein when the flapper member is rotated to the first operational position, the arm portion is rotatable outside of the indented region.

3. The interlock device of claim 1, wherein the base member has a mounting plate and first and second side plates extending outwardly from first and second ends, respectively, of the mounting plate, the mounting plate configured to be coupled to the panel, the aperture of the base member registering with the aperture of the flapper member.

4. The interlock device of claim 3, wherein the flapper member has a cover portion and a protrusion portion coupled to the cover portion, the cover portion rotatably coupled to the first and second side plates of the base member, the cover portion having an indented region therein.

5. The interlock device of claim 4, wherein the aperture extending through the flapper member extends through the cover portion and is disposed proximate to the aperture of the panel.

6. The interlock device of claim 4, wherein the protrusion portion has a first aperture extending therethrough, and when the flapper member is at the first operational position, the protrusion portion is disposed proximate to the panel.

7. The interlock device of claim 6, wherein when the flapper member is at the second operational position the protrusion portion is disposed outwardly from the panel, such that the first aperture of the protrusion portion is not directly adjacent to the first side plate of the base member.

8. The interlock device of claim 7, further comprising a locking device having a locking bail configured to extend through the first aperture of the protrusion portion.

9. The interlock device of claim 6, wherein the protrusion portion has a second aperture extending therethrough and the first side plate of the base member has an aperture extending therethrough, and when the flapper member is at the second operational position the protrusion portion is disposed outwardly from the mounting member such that the second aperture of the protrusion portion is aligned with the aperture of the first side plate.

10. The interlock device of claim 9, further comprising a seal wire configured to be disposed through the second aperture of the protrusion portion and the aperture of the first side plate.

11. The interlock device of claim 1, further comprising a spring operably coupled to the base member and the flapper member that is configured to bias the flapper member toward the second operational position.

12. A switching assembly, comprising:

an interlock device having a base member and a flapper member;

the base member configured to be disposed adjacent to a panel and having an aperture extending therethrough proximate to an aperture of the panel;

the flapper member rotatably coupled to the base member, the flapper member having an aperture extending therethrough that is disposed proximate to the aperture of the panel, the flapper member further having an indented region, the flapper member having a first operational position in which the flapper member is disposed proximate to the panel and a second operational position in which the flapper member is disposed outwardly from the panel;

a selector switch having a body member and a rotatable member, the body member configured to be disposed through the aperture of the flapper member and the aperture in the base member, the body member configured to be mounted to the panel, the body member having an internal region, the rotatable member having a body portion and an arm portion coupled to the body portion, the body portion being at least partially disposed in the internal region of the body member and at least a portion of the body portion extending through the aperture of the base member and through the aperture in the panel, the rotatable member being rotatable between a first rotational position and a second rotational position;

a drive mechanism coupled to the rotatable member proximate to a second side of the panel, the drive mechanism being rotated between a third operational position and a fourth operational position in response to the arm portion of the rotatable member being rotated between the first rotational position and the second rotational position, respectively;

a contact block having an electrical contact with a first operational state when the drive mechanism is at the third operational position, and a second operational state when the drive mechanism is at the fourth operational position;

wherein, when in the second operational position, the indented region receives the arm portion constraining operation of the selector switch and the drive mechanism is maintained at the fourth operational position and the electrical contact is maintained in the second operational state.

13. The switching assembly of claim 12, wherein when the flapper member is rotated to the first operational position, the arm portion is rotatable outside of the indented region to the first operational position and the drive mechanism is moved to the third operational position and the electrical contact is moved to the first operational state.

14. The switching assembly of claim 12, wherein the base member has a mounting plate and first and second side plates extending outwardly from first and second ends, respectively, of the mounting plate, the mounting plate configured to be coupled to the panel, the aperture of the base member extending through the registering with the aperture of the flapper member.

15. The switching assembly of claim 14, wherein the flapper member has a cover portion and a protrusion portion coupled to the cover portion, the cover portion rotatably coupled to the first and second side plates of the base member, the cover portion having an indented region therein.

16. The switching assembly of claim 15, wherein the aperture extending through the flapper member extends through the cover portion and is disposed proximate to the aperture of the panel.

17. The switching assembly of claim 16, wherein when the flapper member is at the second operational position the protrusion portion is disposed outwardly from the panel, such that first aperture of the protrusion portion is not directly adjacent to the first side plate of the base member.

18. The switching assembly of claim 17, further comprising a locking device having a locking bail configured to extend through the first aperture of the protrusion portion.

19. The switching assembly of claim 17, further comprising a hasp device having first and second tip portions configured to extend through the first aperture of the protrusion portion.

20. The switching assembly of claim 15, wherein the protrusion portion has a first aperture extending therethrough, and when the flapper member is at the first operational position, the protrusion portion is disposed proximate to the panel.

21. The switching assembly of claim 20, wherein the protrusion portion has a second aperture extending therethrough and the first side plate of the base member has an aperture extending therethrough, and when the flapper member is at the second operational position the protrusion portion is disposed outwardly from the mounting member such that the second aperture of the protrusion portion is aligned with the aperture of the first side plate.

* * * * *